US009627732B2

(12) United States Patent
Lee et al.

(10) Patent No.: US 9,627,732 B2
(45) **Date of Patent: *Apr. 18, 2017**

(54) CONNECTOR FOR CAVITY FILTER

(71) Applicants: Dongguan ACE Technologies Corp., Dongguan (CN); Ace Technologies Corp., Incheon (KR)

(72) Inventors: Seungheon Lee, Dongguan (CN); Byungsung Kim, Dongguan (CN); Jonghwa Kim, Dongguan (CN)

(73) Assignees: DONGGUAN ACE TECHNOLOGIES CORP., Dongguan (CN); ACE TECHNOLOGIES CORP., Incheon (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/076,316

(22) Filed: Mar. 21, 2016

(65) Prior Publication Data

US 2016/0254607 A1 Sep. 1, 2016

(30) Foreign Application Priority Data

Dec. 31, 2015 (CN) ..... 2015 2 1143303 U

(51) Int. Cl.

| | |
|---|---|
| ***H01R 13/405*** | (2006.01) |
| ***H01P 1/207*** | (2006.01) |
| ***H01P 5/02*** | (2006.01) |
| *H01R 24/38* | (2011.01) |
| *H01R 13/40* | (2006.01) |
| *H01R 13/56* | (2006.01) |

(52) U.S. Cl.
CPC ..... *H01P 1/207* (2013.01); *H01P 5/026* (2013.01); *H01R 13/40* (2013.01); *H01R 13/567* (2013.01); *H01R 24/38* (2013.01)

(58) Field of Classification Search
CPC ..... H01R 13/40; H01R 24/38; H01R 13/567
See application file for complete search history.

(56) References Cited

U.S. PATENT DOCUMENTS

| | | | | | |
|---|---|---|---|---|---|
| 2,238,834 | A * | 4/1941 | Travers | H01R 24/58 | 174/88 C |
| 2,933,714 | A * | 4/1960 | Overholser | H01R 24/545 | 174/74 R |
| 6,126,482 | A * | 10/2000 | Stabile | H01R 24/545 | 439/578 |

(Continued)

*Primary Examiner* — Tho D Ta
(74) *Attorney, Agent, or Firm* — Shimokaji IP

(57) ABSTRACT

A connector adapted for a cavity filter of the present invention includes a contact pin, a first insulator, a housing and a transmission line, the first insulator is provided with a first locating hole, the housing shaped as a cylinder is provided with a second locating hole. During the assembly, no additional mounting slot is required. Less space is taken up by the cylindrical housing, which provides more space for the transmission line and makes the line connections easier therefore. Moreover, the assembly of the connector is simple and efficient, and the connector is in an integrated structure, and the components of the connector are connected by inserting or plugging, which reduces the welding points, thus the vibrations among the components are reduced and the accumulated assembly tolerances are reduced accordingly, thereby the communication quality is improved and the cost is decreased.

14 Claims, 10 Drawing Sheets

(56) References Cited

U.S. PATENT DOCUMENTS

| | | | | |
|---|---|---|---|---|
| 7,458,850 | B1 * | 12/2008 | Burris | H01R 13/025<br>439/582 |
| 9,379,471 | B2 * | 6/2016 | Lee | H01R 13/405 |

* cited by examiner

CONNECTOR FOR CAVITY FILTER

RELATED APPLICATIONS

This application claims the benefit of priority to Chinese Utility Model Application No, 201521143303.5, filed Dec. 31, 2015, which is hereby incorporated by reference in its entirety.

FIELD OF THE INVENTION

The present invention relates to technical field of radio frequency communications and, more particularly to a connector suitable for a cavity filter.

BACKGROUND OF THE INVENTION

Cavity filters serving as frequency selection devices are widely used in communication field, especially in radio frequency communications field. Filters in a base station are used for choosing communication signals and filtering out clutters or interference signals beyond the communication signal frequency. Generally the cavity filter includes a cavity, a cover, a connector and a resonance tube, the cover is located on a top surface of the cavity, the cavity includes a cavity sidewall and several separation ribs for separating the cavity to form a resonant cavity, and the connector is generally mounted on a side or a bottom of the cavity, sometimes is mounted on the top surface of the cavity.

As shown in FIGS. 1*a*, 1*b*, conventionally, the connector is mounted on the top surface of the cavity in the following manner: firstly machining a mounting slot 20 in a top surface of the isolation ribs or a top surface of the cavity sidewall, the mounting slot 20 communicates with the resonant cavity, and then installing the connector 21 in the mounting slot 20, and welding an inner conductor 210 of the connector 21 to a cable 22. The cable 22 passes through the mounting slot 20 and is extended to the resonant cavity and welded to the resonance tube 23 in the resonant cavity, in such a way, signals between the inner conductor 210 of the connector 21 and the resonant cavity are connected.

However, the conventional connector has the following disadvantages: (1) a mounting slot is required to receive the connector, which limits the space to a certain extent; (2) the structure of the connector is not compact, thus vibrations are easily generated among the components of the connector, and accumulated assembly tolerances would be generated during the assembly, the components thereof require multiple welding points for connecting, thereby communication quality is degraded and assembly efficiency is reduced; (3) the cost is high.

SUMMARY OF THE INVENTION

One Objective of the present invention is to provide a connector adapted for a cavity filter having an integrated structure, which requires no mounting slot to receive the connector, reduces vibrations among components and accumulated assembly tolerances, and decreases welding points thereby improving communication quality and assembly efficiency and reducing the cost.

To achieve the above-mentioned objective, a connector adapted for a cavity filter of the present invention includes a contact pin, a first insulator, a housing and a transmission line, wherein the first insulator is provided with a first locating hole, the housing shaped as a cylinder is provided with a second locating hole, the contact pin is inserted into the first and the second locating hole in turn, the first insulator is received in the second locating hole, an upper end of the contact pin is located outside the housing, and the transmission line has a first end inserted into the second locating hole and connected with a lower end of the contact pin and a second end connected with a resonance tube of the cavity filter.

In comparison with the prior art, since the connector according to the present invention has the cylindrical housing, thus the connector can be directly mounted in the circular cavity of the cavity filter without an additional mounting slot formed. Further, less space is taken up by the cylindrical housing, which provides more space for the transmission line and makes the line connections easier therefore. Moreover, the assembly of the connector is simple and efficient, firstly the contact pin is inserted into the first locating hole, and then the both is inserted into the second locating hole so that the first insulator is received in the second locating hole, finally the first end of the transmission line is inserted into the second locating hole to connect with the lower end of the contact pin. By this token, the connector is in an integrated structure, and the components of the connector are connected by inserting or plugging, which reduces the welding points, thus the vibrations among the components are reduced and the accumulated assembly tolerances are reduced accordingly, thereby the communication quality is improved and the cost is decreased.

As an embodiment, the housing includes a first housing portion, a second housing portion and a cover, both of the first and the second housing portions are cylindrical, the second housing portion is sleeved on the first housing portion, and second housing portion is sealed by the cover.

Preferably, the first housing portion comprises a first cylindrical body and a second cylindrical body that are vertical and communicated with one another, the second housing portion comprises a third cylindrical body that is vertical and a fourth cylindrical body that is horizontal and communicated with the third cylindrical body, an inner diameter of the first cylindrical body is larger than that of the third cylindrical body, and the third cylindrical body is sleeved on the second cylindrical body.

Preferably, the second cylindrical body is provided with an inserting hole, the first end of the transmission line passes through the fourth cylindrical body and the inserting hole to connect with the lower end of the contact pin.

Preferably, the connector further comprises a second insulator which is located in the third cylindrical body and between the lower end of the contact pin and the cover.

Preferably the connector further comprises a gasket which has a flange rib, wherein the first insulator is provided with a receiving groove in which the flange rib is inserted.

As another preferable embodiment, the housing comprises a first housing portion, a second housing portion and a cover, the first housing portions is cylindrical, the second housing portion is cuboidal, the second housing portion is mounted on the first housing portion, and second housing portion is sealed by the cover.

Preferably, the first housing portion is provided with a first through hole, the second housing portion is provided with a second through hole which is communicated with the first through hole, a side wall of the second housing portion is provided with an inserting hole, and the first end of the transmission line passes through the inserting hole to connect with the lower end of the contact pin.

Preferably, the connector further comprises a gasket ring, wherein the first housing portion comprises an annular groove in which the gasket ring is received.

Preferably, the transmission line and the contact pin are fixed by welding.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

Figure 1A:
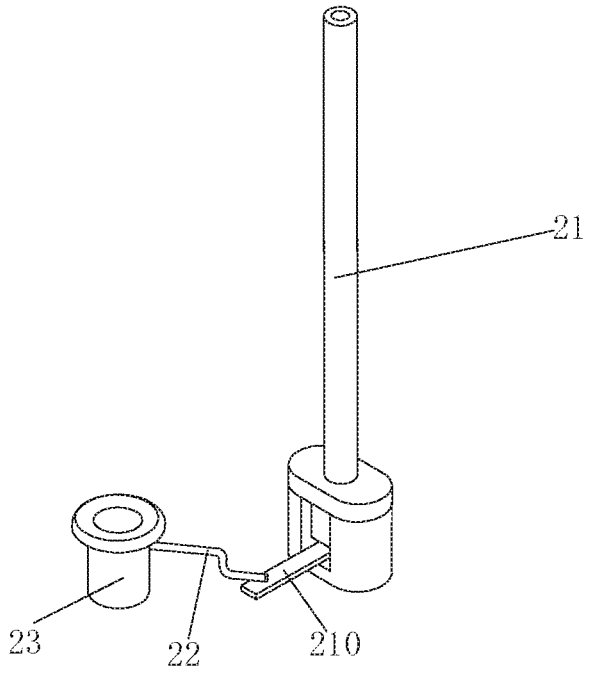
Fig.1a (Prior Art)
FIG. 1*a* is a perspective view of a conventional connector for a cavity filter.
Figure 1B:
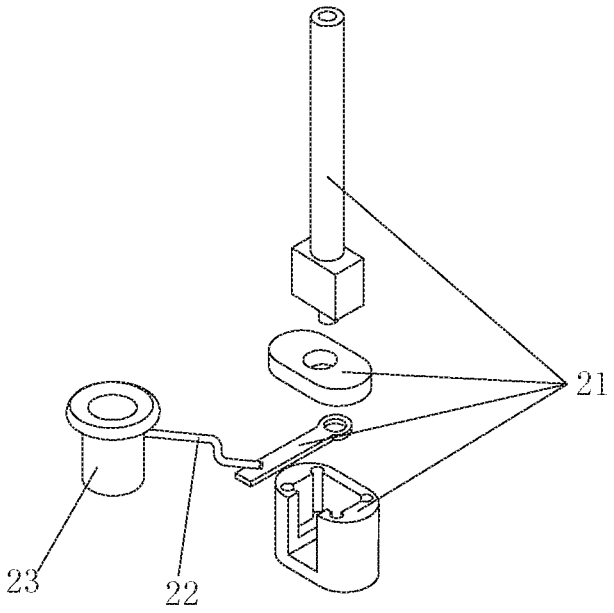
Fig.1b (Prior Art)
FIG. 1*b* is an exploded view of the connector shown in FIG. 1*a;*
Figure 2:
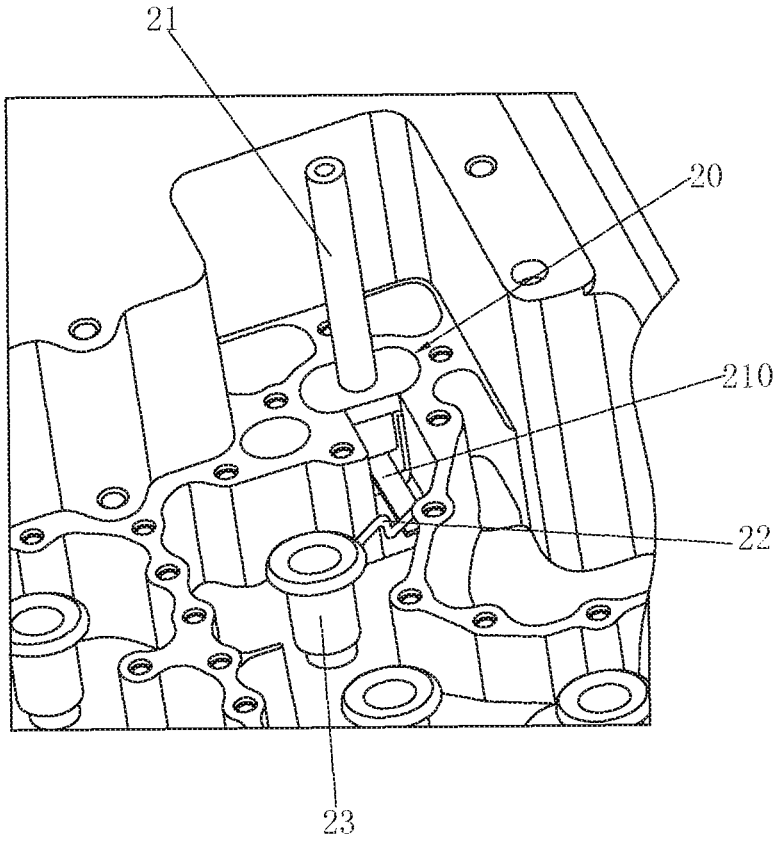
Fig.2 (Prior Art)
FIG. 2 is a partial view of the conventional connector and the cavity filter after assembly.

Various preferred embodiments of the invention will now be described with reference to the figures, wherein like reference numerals designate similar parts throughout the various views.

Figure 3:
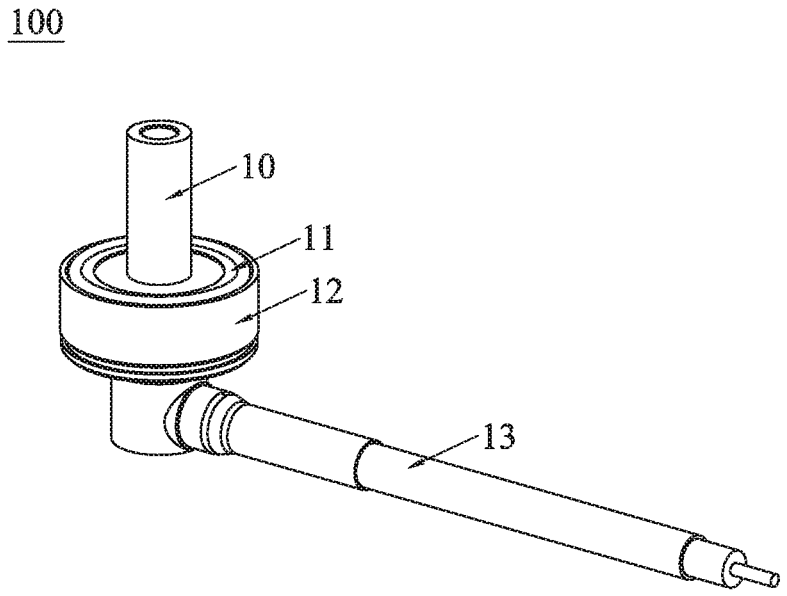
FIG. 3 is a perspective view of a connector for a cavity filter according to a first embodiment of the present invention.
Figure 7:
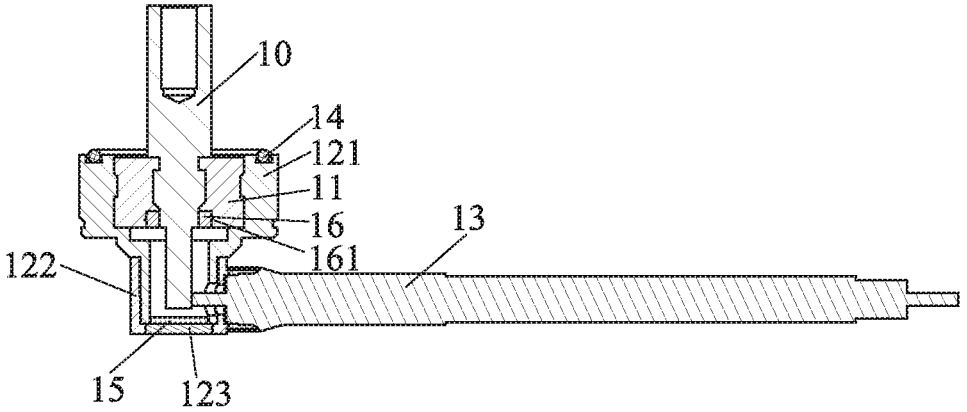
FIG. 7 is a sectional view of FIG. 6 along A-A line.
Figure 8:
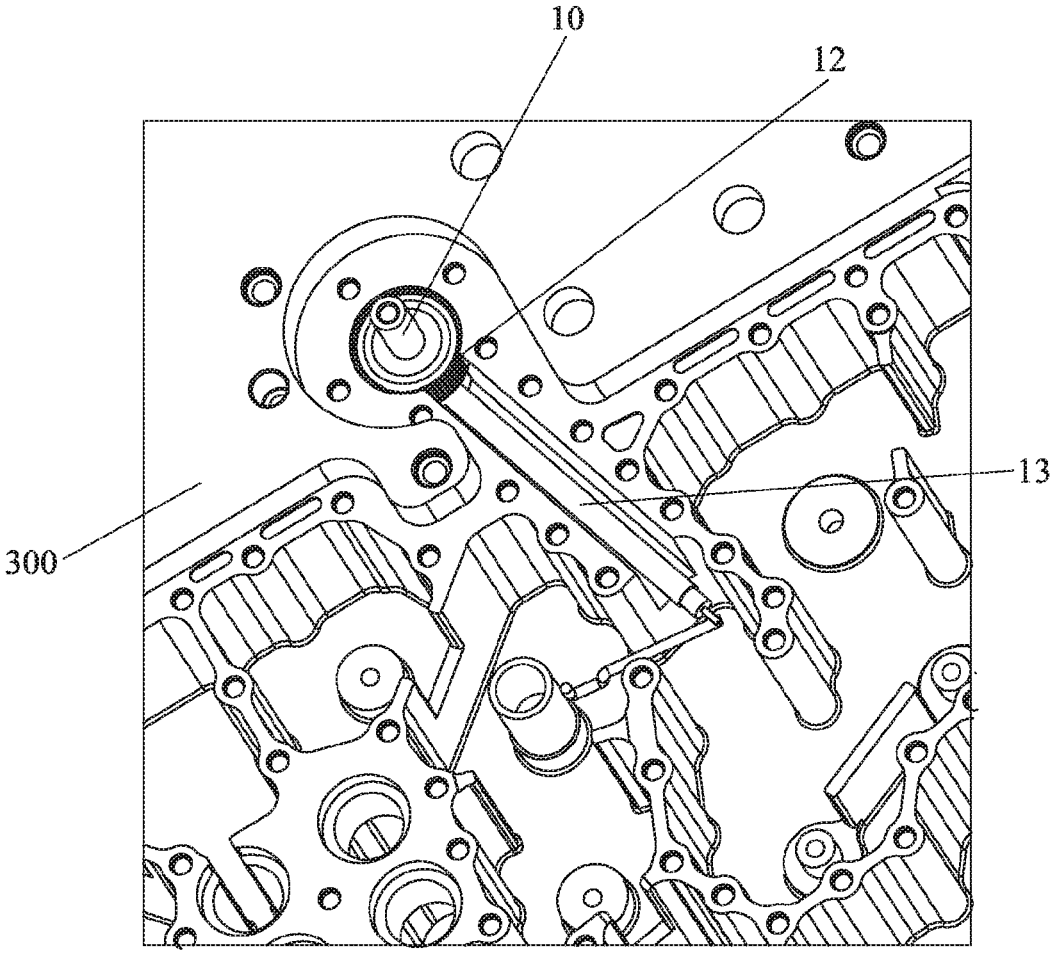
FIG. 8 is a partial view of the connector in FIG. 3 and the cavity filter after assembly.

Referring to FIGS. 3 to 7, a connector 100 adapted for a cavity filter of the present invention includes a contact pin 10, a first insulator 11, a housing 12 and a transmission line 13. Specifically, the first insulator 11 includes a first locating hole 111, the housing 12 includes a second locating hole (not shown), the contact pin is inserted into the first locating hole 111 and the second locating hole in turn, and the first insulator 11 is received in the second locating hole of the housing 12 (as shown in FIG. 3 and FIG. 7). An upper end of the contact pin 10 is located outside the housing 12, and the transmission line 13 has a first end inserted into the second locating hole and connected with the contact pin 10 (as shown in FIG. 7), and a second end connected with a resonance tube of the cavity filter (as shown in FIG. 8). Specifically, the transmission line 13 is welded to the contact pin 10 firmly.

Figure 4:
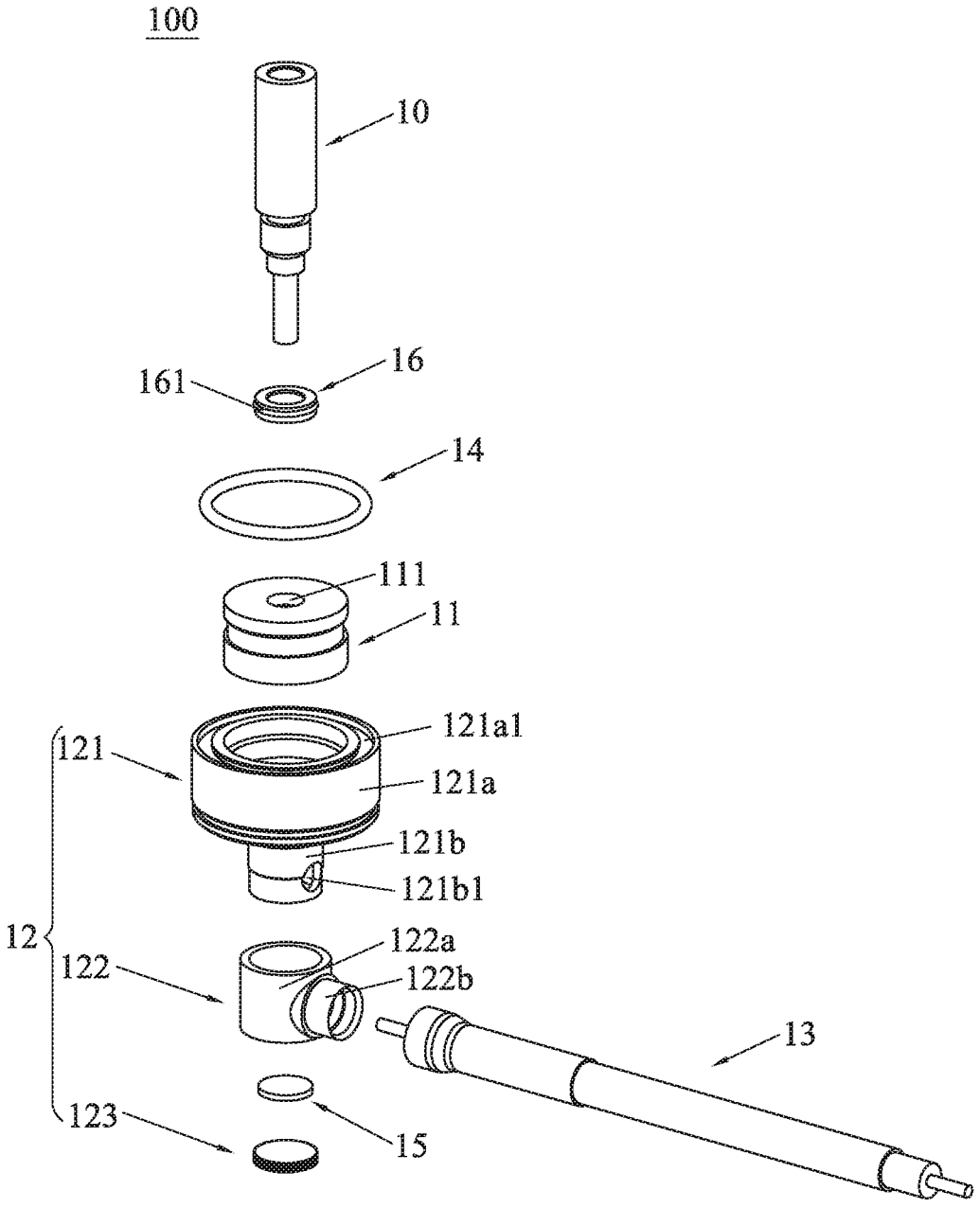
FIG. 4 is an exploded view of FIG. 3.
Figure 5:
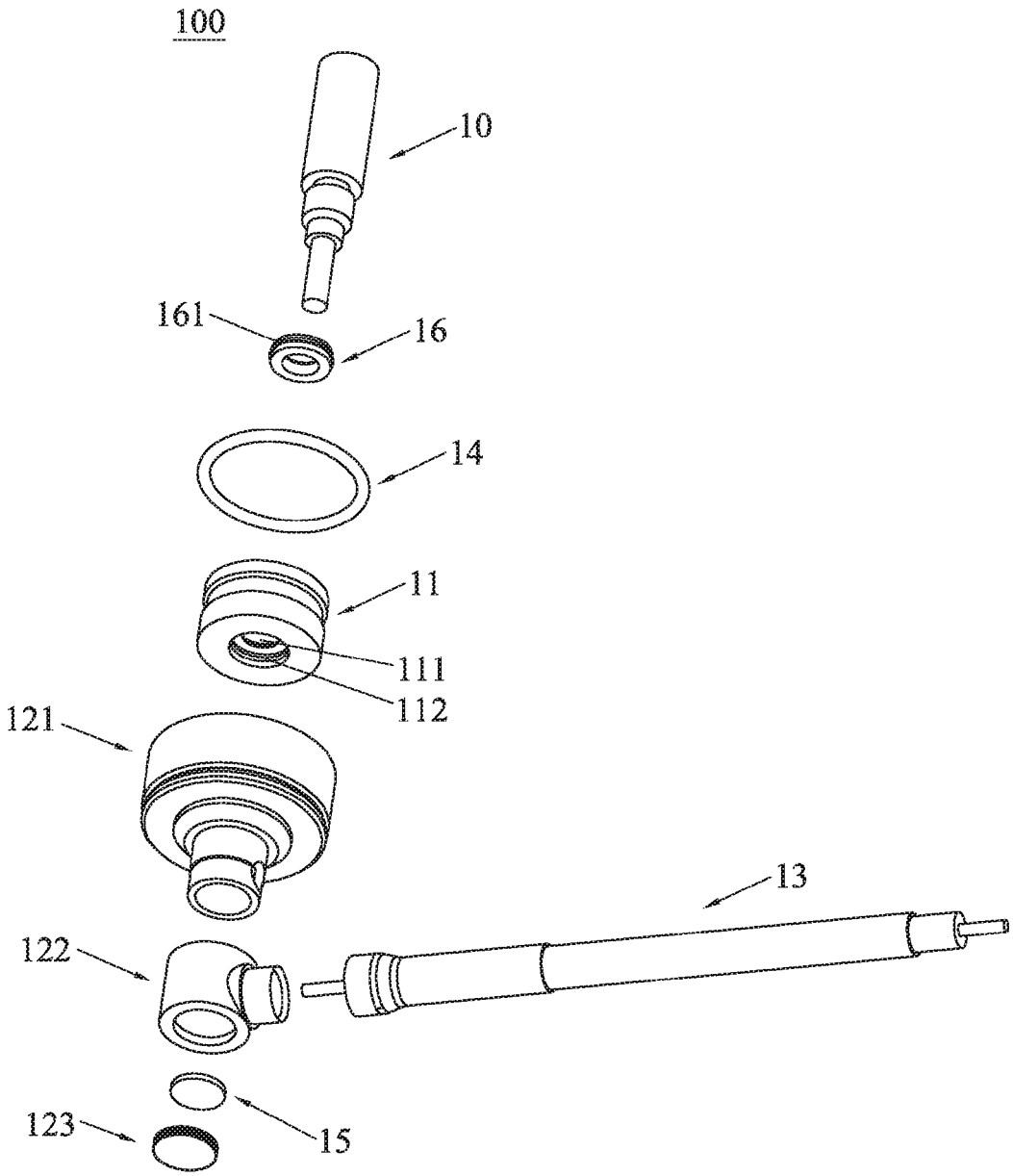
FIG. 5 is another exploded view of FIG. 3.
Figure 6:
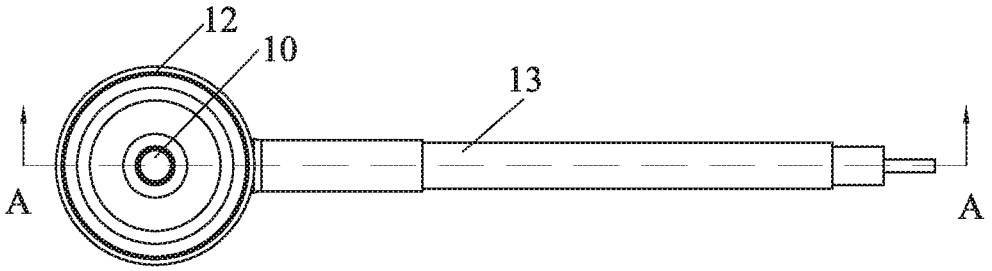
FIG. 6 is a top view of FIG. 3.

As shown in FIGS. 4 and 5, the housing 12 includes a first housing portion 121, a second housing portion 122 and a cover 123 that is circular. Both of the first and the second housing portions 121, 122 are cylindrical, the second housing portion 122 is sleeved on the first housing portion 121, and second housing portion 122 is sealed by the cover 123.

Further, the first housing portion 121 includes a first cylindrical body 121*a* and a second cylindrical body 121*b* that are vertical and communicated with one another, the second housing portion 122 includes a third cylindrical body 122*a* that is vertical and a fourth cylindrical body 122*b* that is horizontal, and the third cylindrical body 122*a* and the fourth cylindrical body 122*b* are communicated with one another. The inner diameter of the first cylindrical body 121*a* is larger than that of the third cylindrical body 122*a*, and the third cylindrical body 122*a* is sleeved on the second cylindrical body 121*b*. As a result, after the first housing portion 121 and the second housing portion 122 are assembled together, the four cylindrical body 121*a*, 121*b*, 122*a*, 122*b* constitute the second locating hole. Furthermore, an annular groove 121*a*1 is formed on the first cylindrical body 121*a*, and a gasket ring 14 is received in the annular groove 121*a*1. An inserting hole 121*b*1 is formed on the second cylindrical body 121*a*, and the first end of the transmission line 13 passes through the fourth cylindrical body 122*b* and the inserting hole 121*b*1 in turn to connect with the lower end of the contact pin 10.

Further, the connector 100 includes a second insulator 15 which is located in the third cylindrical body 122*a* and between the lower end of the contact pin 10 and the cover 123.

Further, the connector 100 includes a gasket 16 which has a flange rib 161. Accordingly, the first insulator 11 has a receiving groove 112 in which the flange rib 161 is inserted (as best shown in FIG. 7).

Referring to FIG. 8 which shows the assembly view of the connector 100. As illustrated, after the connector 100 is assembled, the cylindrical housing 12 is directly installed in the cavity of the cavity filter 300, and no additional mounting slot used for receiving the connector 100 is formed in the cavity filter 300, further less space is taken up by the cylindrical housing 12, which provides more space for the transmission line and makes the line connections easier.

Figure 9:
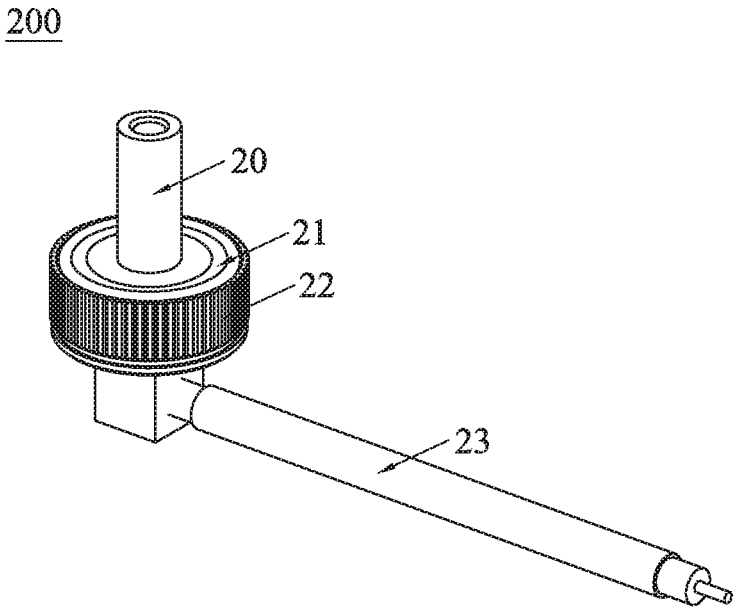
FIG. 9 is a perspective view of a connector for a cavity filter according to a second embodiment of the present invention.
Figure 10:
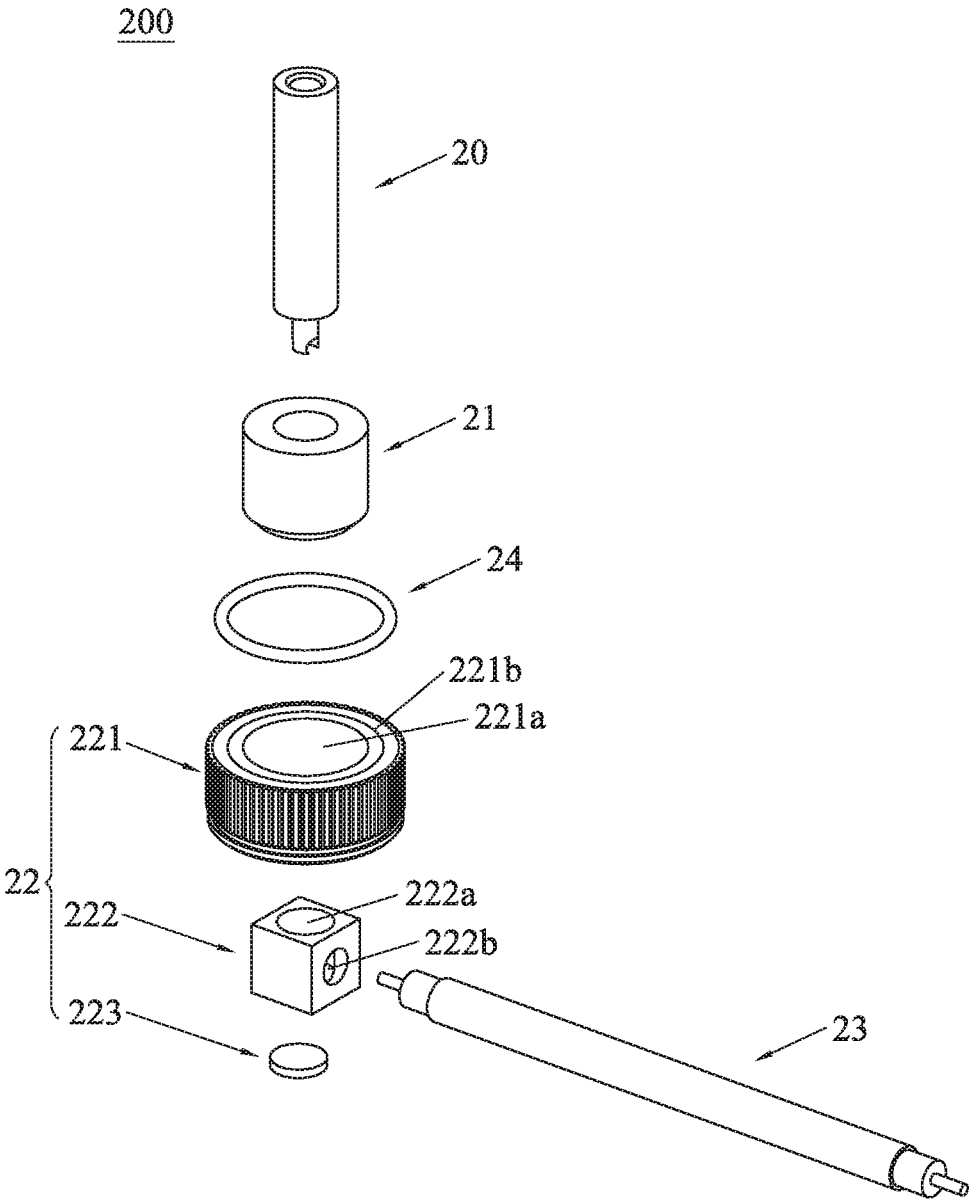
FIG. 10 is an exploded view of FIG. 9.
Figure 11:
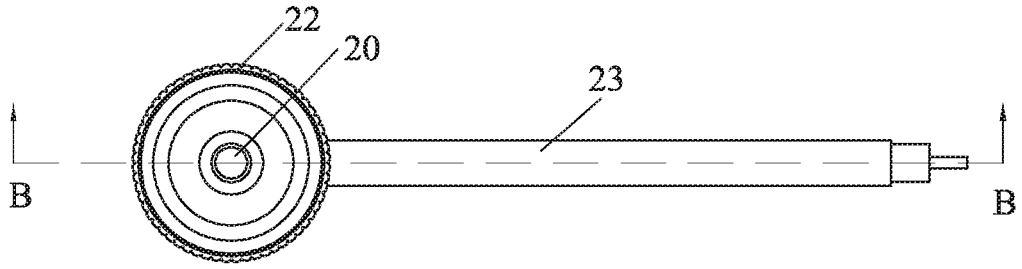
FIG. 11 is a top view of FIG. 9.
Figure 12:
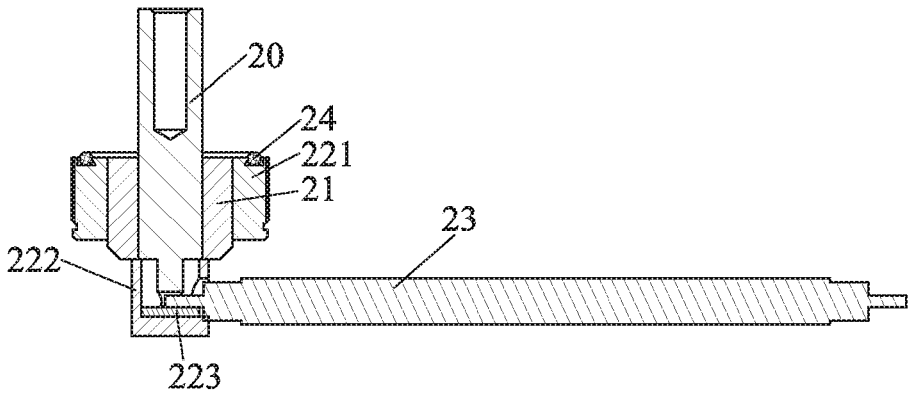
FIG. 12 is a sectional view of FIG. 11 along B-B line.

Referring to FIG. 9 and FIG. 12, a second embodiment is shown. The connector 200 in the present embodiment includes a contact pin 20, a first insulator 21 and a gasket ring 24, a housing 22 and a transmission line 23.

Differences between the present embodiment and the first embodiment include: the housing 22 includes a first housing portion 221, a second housing portion 222 and a cover 223, the first housing portion 221 is cylindrical, the second housing portion 222 is cuboidal, the second housing portion 222 is mounted on the first housing portion 221, and second housing portion 222 is sealed by the cover 223. Specifically, the first housing portion 221 includes a first through hole 221*a* and an annular groove 221*b*, and the gasket ring 24 is received in the annular groove 221*b*. The second housing portion 222 includes a second through hole 222*a* which is communicated with the first through hole 221*a*. A side wall of the second housing portion 222 has an inserting hole 222*b*, and the first end of the transmission line 23 passes through the inserting hole 222*b* to connect with the lower end of the contact pin 10. The first through hole 221*a*, the second through hole 222*a* and the inserting hole 222*b* constitute the second locating hole. In addition, no gasket 16 and second insulator 15 are required in this embodiment. The structures and connections for the rest components are the same with the first embodiment, which are omitted here.

Additionally, it should be noted that, since the assembly view of the connector 200 and the cavity filter is the same with the first embodiment, which is omitted here therefore.

By this token, since the connector adapted for cavity filters according to the present invention has the cylindrical housing, thus the connector can be directly mounted in the circular cavity of the cavity filter without an additional mounting slot formed. Further, less space is taken up by the cylindrical housing, which provides more space for the transmission line and makes the line connections easier therefore. Moreover, the assembly of the connector is simple and efficient, firstly the contact pin is inserted into the first locating hole, and then the both is inserted into the second locating hole so that the first insulator is received in the second locating hole, finally the first end of the transmission line is inserted into the second locating hole to connect with the lower end of the contact pin. By this token, the connector is in an integrated structure, and the components of the connector are connected by inserting or plugging, which reduces the welding points, thus the vibrations among the components are reduced and the accumulated assembly tolerances are reduced accordingly, thereby the communication quality is improved and the cost is decreased.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention.

What is claimed is:

1. A connector adapted for a cavity filter, comprising a contact pin, a first insulator, a housing and a transmission line, wherein the first insulator is provided with a first locating hole, the housing shaped as a cylinder is provided with a second locating hole, the contact pin is inserted into the first and the second locating hole in turn, the first insulator is received in the second locating hole, an upper end of the contact pin is located outside the housing, and the transmission line has a first end inserted into the second locating hole and connected with a lower end of the contact pin and a second end connected with a resonance tube of the cavity filter;

the housing comprises a first housing portion, a second housing portion and a cover, both of the first and the second housing portions are cylindrical, the second housing portion is sleeved on the first housing portion, and second housing portion is sealed by the cover; the first housing portion comprises a first cylindrical body and a second cylindrical body that are vertical and communicated with one another, the second housing portion comprises a third cylindrical body that is vertical and a fourth cylindrical body that is horizontal and communicated with the third cylindrical body, an inner diameter of the first cylindrical body is larger than that of the third cylindrical body, and the third cylindrical body is sleeved on the second cylindrical body.

2. The connector adapted for a cavity filter according to claim 1, further comprising a gasket ring, wherein the first housing portion comprises an annular groove in which the gasket ring is received.

3. The connector adapted for a cavity filter according to claim 1, further comprising a gasket ring, wherein the first housing portion comprises an annular groove in which the gasket ring is received.

4. The connector adapted for a cavity filter according to claim 1, wherein the transmission line and the contact pin are fixed by welding.

5. The connector adapted for a cavity filter according to claim 1, wherein the second cylindrical body is provided with an inserting hole, the first end of the transmission line passes through the fourth cylindrical body and the inserting hole to connect with the lower end of the contact pin.

6. The connector adapted for a cavity filter according to claim 5, further comprising a gasket ring, wherein the first housing portion comprises an annular groove in which the gasket ring is received.

7. The connector adapted for a cavity filter according to claim 5, further comprising a second insulator which is located in the third cylindrical body and between the lower end of the contact pin and the cover.

8. The connector adapted for a cavity filter according to claim 7, further comprising a gasket ring, wherein the first housing portion comprises an annular groove in which the gasket ring is received.

9. The connector adapted for a cavity filter according to claim 1, wherein the housing comprises a first housing portion, a second housing portion and a cover, the first housing portions is cylindrical, the second housing portion is cuboidal, the second housing portion is mounted on the first housing portion, and second housing portion is sealed by the cover.

10. The connector adapted for a cavity filter according to claim 9, further comprising a gasket ring, wherein the first housing portion comprises an annular groove in which the gasket ring is received.

11. The connector adapted for a cavity filter according to claim 7, further comprising a gasket which has a flange rib, wherein the first insulator is provided with a receiving groove in which the flange rib is inserted.

12. The connector adapted for a cavity filter according to claim 11, further comprising a gasket ring, wherein the first housing portion comprises an annular groove in which the gasket ring is received.

13. The connector adapted for a cavity filter according to claim 9, wherein the first housing portion is provided with a first through hole, the second housing portion is provided with a second through hole which is communicated with the first through hole, a side wall of the second housing portion is provided with an inserting hole, and the first end of the transmission line passes through the inserting hole to connect with the lower end of the contact pin.

14. The connector adapted for a cavity filter according to claim 13, further comprising a gasket ring, wherein the first housing portion comprises an annular groove in which the gasket ring is received.

* * * * *